US005711130A

United States Patent [19]

Shatley

[11] Patent Number: 5,711,130

[45] Date of Patent: Jan. 27, 1998

[54] BUILDING BLOCK

[76] Inventor: Josh L. Shatley, 8900 Davis Blvd., Fort Worth, Tex. 76180

[21] Appl. No.: 746,764

[22] Filed: Nov. 15, 1996

Related U.S. Application Data

[60] Provisional application No. 60/006,922, Nov. 17, 1995.

[51] Int. Cl.[6] ..... E04C 1/00

[52] U.S. Cl. ..... 52/604; 52/100; 52/603; 52/606; 52/608; 52/610; 405/284; 405/286

[58] Field of Search ..... 52/100, 603, 604, 52/606, 608, 609, 610; 405/284, 286; 249/52

[56] References Cited

U.S. PATENT DOCUMENTS

| | | | |
|---|---|---|---|
| 3,036,407 | 5/1962 | Dixon . | |
| 3,430,404 | 3/1969 | Muse . | |
| 3,609,926 | 10/1971 | Muse | 52/604 X |
| 3,922,832 | 12/1975 | Dicker . | |
| 3,936,987 | 2/1976 | Calvin . | |
| 3,995,434 | 12/1976 | Kato et al. . | |
| 4,110,949 | 9/1978 | Cambluzzi et al. . | |
| 4,207,718 | 6/1980 | Schaaf et al. . | |
| 4,312,606 | 1/1982 | Sarikelle . | |
| 4,802,320 | 2/1989 | Forsberg . | |
| 4,825,619 | 5/1989 | Forsberg . | |
| 4,914,876 | 4/1990 | Forsberg . | |
| 5,031,376 | 7/1991 | Bender et al. | 52/608 X |
| 5,062,610 | 11/1991 | Woolford et al. . | |
| 5,161,918 | 11/1992 | Hodel . | |
| 5,294,216 | 3/1994 | Sievert . | |
| 5,598,679 | 2/1997 | Orton et al. | 52/608 X |

*Primary Examiner*—Carl D. Friedman
*Assistant Examiner*—Timothy B. Kang
*Attorney, Agent, or Firm*—James E. Bradley

[57] ABSTRACT

A building block for a wall enables the blocks to be mounted in offset and flush modes. The block has an extension portion on the bottom, making the bottom longer than the top. The rearward lug protrudes from the bottom at the extension portion. The forward lug protrudes from the bottom forward of the rearward lug. In the offset mode, the upper row of blocks rests on the lower row with the forward lug of the upper row engaging the rearward end of the lower row of blocks. In the flush mode, the forward lug is removed and the blocks positioned with the forward end substantially flush. The rearward lugs of the upper row will then engage the rearward ends of the lower row. Holes extend through the blocks for receiving pins for interlocking them together. Some of the holes are elongated. The pins have enlarged heads which locate in the elongated holes, but will not fit in the cylindrical holes.

9 Claims, 3 Drawing Sheets

BUILDING BLOCK

This application claims the benefit of U.S. Provisional Application No. 60/006,922, Nov. 17, 1995.

TECHNICAL FIELD

This invention relates in general to building blocks for building walls.

BACKGROUND ART

One type of wall, particularly retaining walls, is built using building blocks formed of a concrete material. The blocks stack one on another in rows. In one style, the offset mode, each row is offset rearward from the row immediately below it. In another style, referred to as the flush mode, the forward ends or faces of the blocks are substantially flush with each other.

When building the wall, some type of means is needed to hold the blocks in the flush and in the offset mode. One prior art technique uses pins which insert through holes and recesses in the blocks. These pins will hold the blocks in either the flush mode or offset mode positions. While workable, improvements are desired.

SUMMARY OF INVENTION

In this invention, the building blocks have a top, bottom, two sides facing in opposite directions, a forward end or face, and rearward end. The bottom of each block has an extension portion which extends rearward of a junction with the rearward end and the top. The bottom is thus longer than the top. A rearward lug protrudes from the extension portion of the bottom. Also, a forward lug protrudes from the bottom adjacent to and forward of the rearward lug.

The blocks may be stacked in an offset mode with the forward end of an upper row recessed from the forward end of the lower row. In this instance, the forward lug of the upper row engages the rearward end of the lower row. The blocks may also be stacked in a flush mode. The flush mode, the forward row is removed, preferably by striking a blow with a chisel. The upper row then rests on the lower row with the reward lug engaging the rearward end of the blocks of the lower row.

In addition to the lugs, if the wall is of a certain height, holes must be provided through the block for receiving pins to interlock the rows of the blocks together. Preferably the holes extend completely through the block with a forward row of holes and a rearward row of holes. The forward row includes at least some elongated holes which have greater widths than the cylindrical holes of the rearward row.

The pins have enlarged heads which will not extend through the cylindrical holes, but which can locate in the elongated holes. In the flush mode, the pins extend between the forward rows of the blocks. In the offset mode, the pins extend between the forward row of the upper blocks and the rearward row of the lower row of blocks.

DETAILED DESCRIPTION OF THE INVENTION

Figure 1:
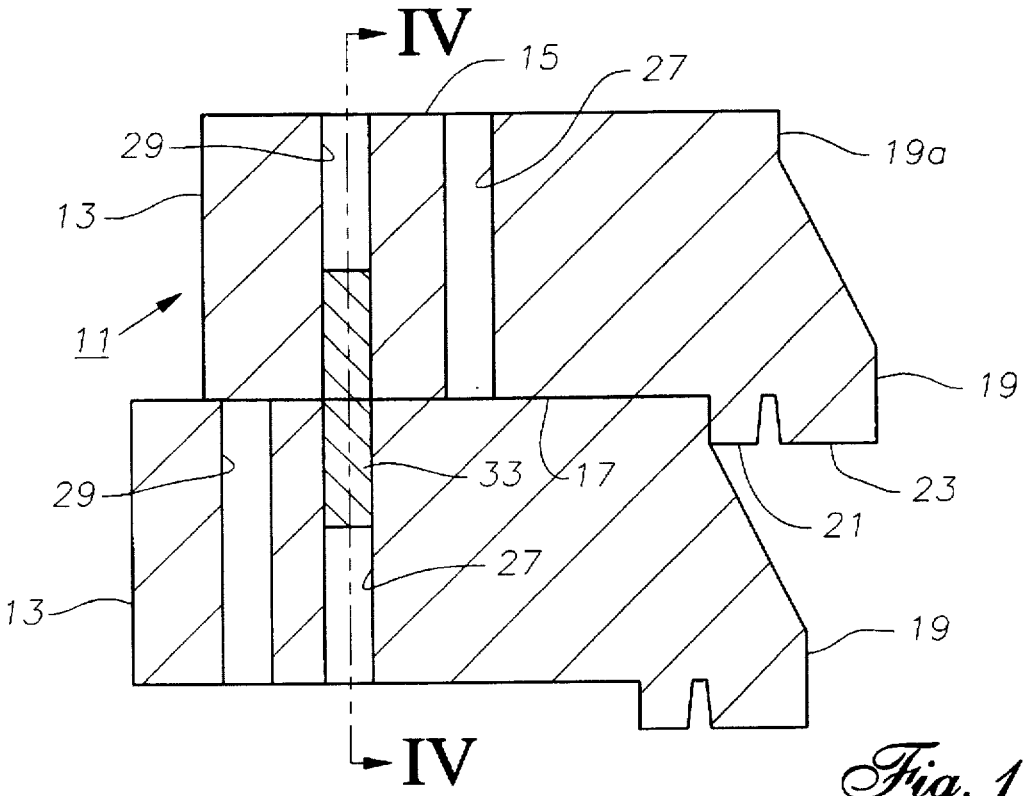
FIG. 1 is a side sectional view illustrating two tiers of building blocks constructed in accordance with this invention, and shown stacked in an offset or setback position.
Figure 3:
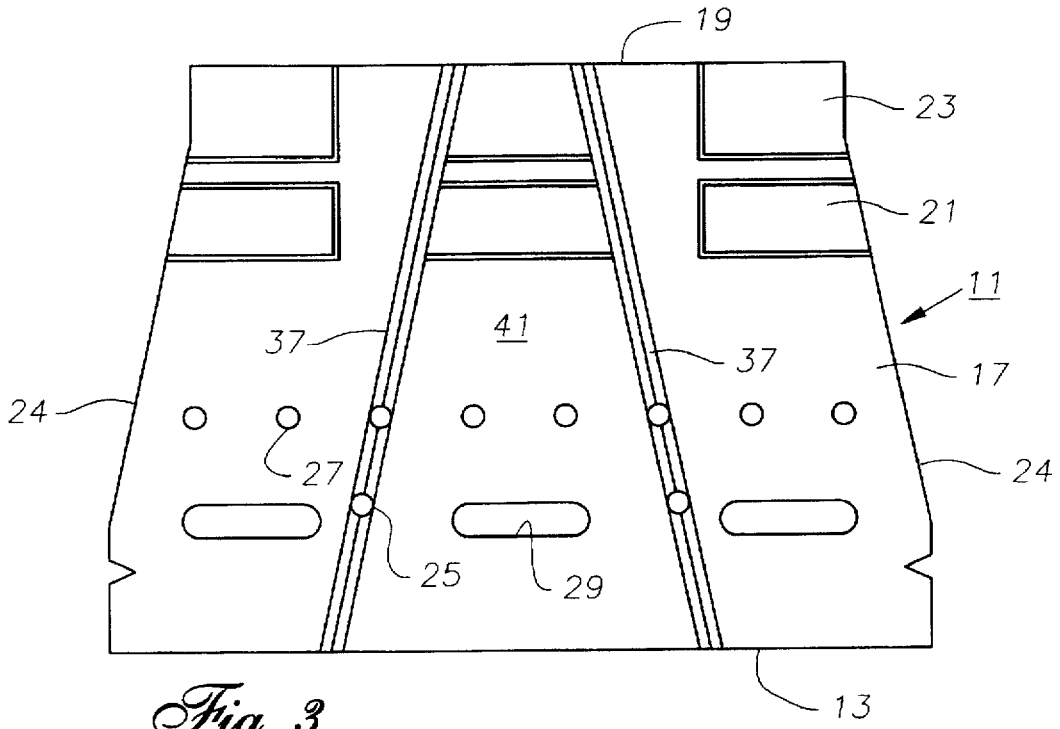
FIG. 3 is a bottom view of one of the building blocks of FIG. 1.

Referring to FIG. 1, building block 11 is a construction block of concrete or other composite material for use in building walls. Each block 11 is identical and has a front face 13, a top 15, and a bottom 17. Front face 13 is flat and perpendicular to top 15 and bottom 17. Rear wall 19 tapers rearwardly from the top 15 to the bottom 17, with the upper portion **19*a* being more forward of the lower portion. Forward and rearward rows of lugs 21, 23 are formed integrally on bottom 17. Referring to FIG. 3, there are two side walls 24. Side walls 24 taper, providing a greater width at face 13 than at rear wall 19**.

As shown in FIG. 3, there are three spaced apart lugs within each row 21, 23, with each row extending across the full width of building block 11. Each row of lugs 21, 23 is parallel to the other and parallel to face 13. Each lug 21, 23 protrudes downward from bottom 17. The length from front face 13 to the rear edge of rearward lugs 23 is greater than the length of top 15.

The offset position of FIG. 1 shows two tiers of blocks 11 stacked to create an offset wall. In the offset position, blocks 11 will be stacked so that the front face 13 of the next upper tier of blocks 11 will be set back from the next lower tier. The forward lugs 21 will abut against the rear wall 19, determining the degree of offset. The forward edge of the forward row of lugs 21 abuts against the upper portion **19*a*** of the rear wall.

Figure 2:
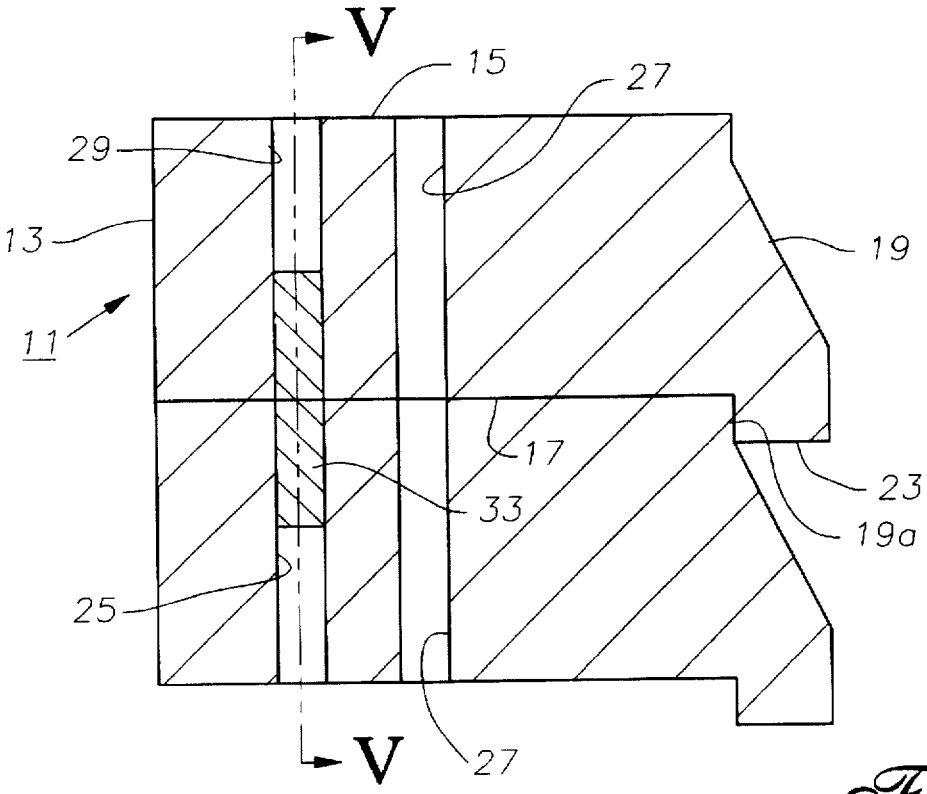
FIG. 2 is a side sectional view of the tiers of building blocks of FIG. 1, shown stacked in a vertically flush position.

When it is desired to have a wall with a vertically flush face, the builder will chisel off the forward row of lugs 21. Generally, a single blow with a hammer to a sharp chisel will remove one of the lugs 21. Block 11 will now have only a single row of lugs 23 as shown in FIG. 2. The distance from front face 13 to the forward edge of lugs 23 is selected to be the same as the length of top 15. This results in the front faces 13 being substantially vertically flush with one another. In actuality, there will be a slight rearward offset of about ¼ inch of the upper tier of blocks 11 relative to the lower tier of blocks 11.

For relatively low walls, the blocks 11 are simply stacked on one another without mortar or pinning. For higher walls, it may be necessary to use pins. As shown in FIG. 3, the pin arrangement shown in the drawings consists of a front row of elongated holes 29. There are three elongated holes 29, each spaced apart from the other. Elongated holes 29 are located in a straight line parallel to and spaced rearward from face 13 slightly greater than the amount of offset when blocks 11 are in the offset position. Elongated holes 29 extend completely through the height of block 11. When stacked in the offset position, as shown in FIG. 1, elongated holes 29 will be covered by the top 17 of the next upper tier of blocks 11.

There are two cylindrical holes 25 located in a front row and spaced between the elongated holes 29. Cylindrical holes 25 have centerlines spaced a short distance rearward of the centerlines of the elongated holes 29 to provide the ¼ inch offset for the vertical position mentioned above. There is a rearward row of cylindrical holes 27 spaced back from the elongated holes 29. Rearward holes 27 are in a row parallel to the row of elongated holes 29 and spaced across the width of block 11. Rearward holes 27 and forward holes 25 also extend completely through the height of block 11. Holes 25, 27 have identical diameters. The shorter dimension of each elongated hole 29 from the forward side to the rearward side of each elongated hole 29 is about the same as the diameter of each hole 25, 27. The longer dimension of each elongated hole 29 is about three times the shorter dimension and is the same as the distance from opposite edges of two adjacent holes 27.

Referring also to FIG. 3, steel pins 33 are employed to pin an upper tier of blocks 11 to a lower tier of blocks. Pins 33 are steel rods that have a thicker upper section 33*a* than a lower section or leg 33*b*. Pins 33 may be formed of cylindrical rods, doubled over or welded together to form the upper section 33*a* as shown. The lower leg 33*b* is slightly smaller in diameter than the cylindrical holes 25, 27 to closely fit within one of them. The lower leg 33*b* is not centered on the upper portion 33*a*, rather it is offset to one side, creating an overhanging portion of upper portion 33*a*. The upper section 33*b* is too wide to fit within one of the cylindrical holes 25, 27, but fits readily in the elongated holes 29.

Figure 4:
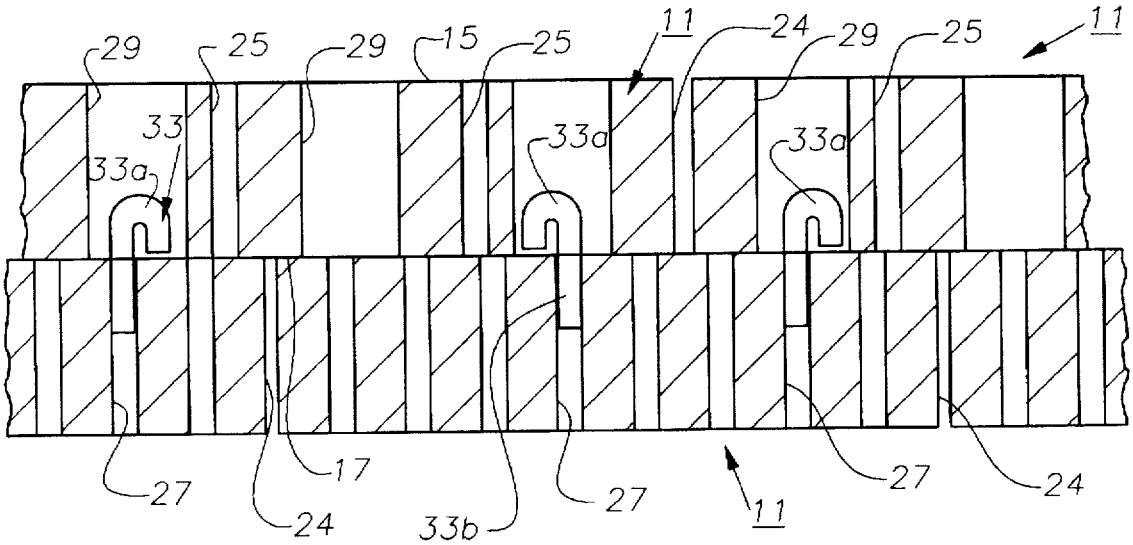
FIG. 4 is a sectional view of the building blocks of FIG. 1, taken along the line IV—IV of FIG. 1.

Referring to FIGS. 1 and 4, when in the offset position, the lower legs 33*b* of two pins 33 will each locate within one of the rearward cylindrical holes 27 of the next lower tier. The upper section 33*b* will fit within one of the elongated holes 29 of the upper tier of blocks 11. However, the width of the upper section 33*b* is not as wide as the elongated holes 29, to allow adjustment in position. One pin 33 will be adjacent one side 24, while the other will be adjacent the other side 24 of the upper tier. The wider upper sections 33*a* prevent the pins 33 from falling through the blocks 11. Pins 33 can be rotated about legs 33*b* to place the overhanging portion of upper section 33*a* to the right or to the left of the leg 33*b* to accommodate an elongated hole 29. Preferably pin upper section 33*a* is oriented to be as close as possible to one of the side edges of an elongated hole 29 to tighten adjacent blocks 11 together of a tier.

Although not shown, the lower tier of blocks 11 in FIG. 4 will have pins 33 extending from their elongated holes 29 down into holes 27 in the next lower tier. Similarly, the upper tier of blocks 11 shown in FIG. 4 will receive legs 33*b* of pins 33 from a next upper tier of blocks 11. The elongated holes 29 allow the blocks 11 to be arranged in a straight wall with faces 13 within each tier in a plane. Alternately, the elongated holes 29, tapered side walls 24, and multiple rearward holes 27 allow the builder to provide a curved wall, either convex or concave.

Figure 5:
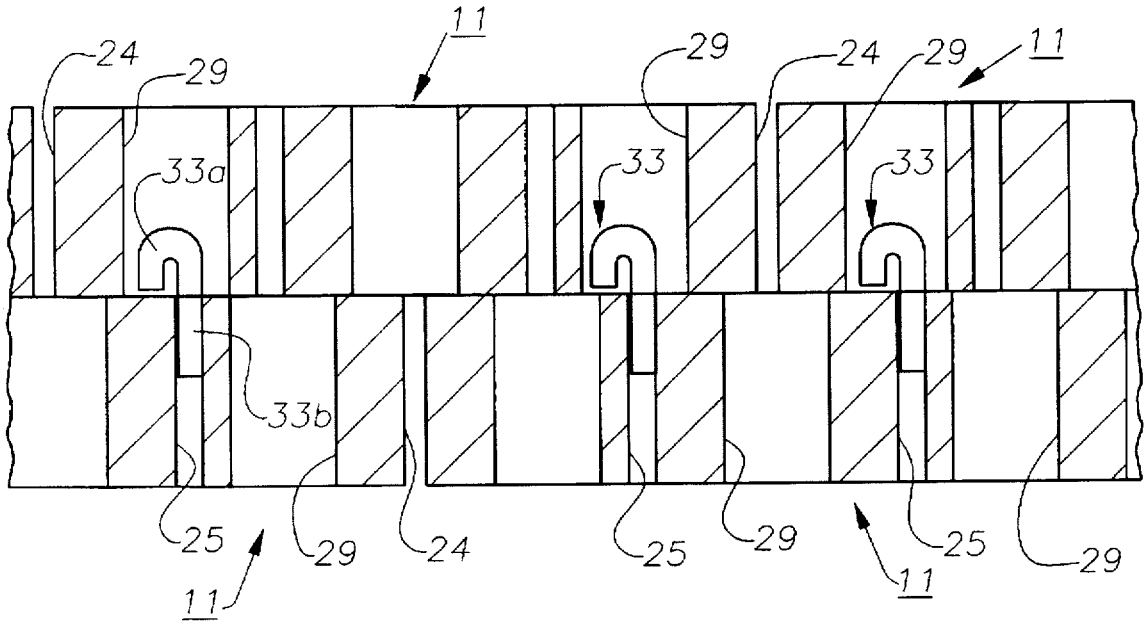
FIG. 5 is a sectional view of the building blocks of FIG. 2, taken along the line V—V of FIG. 2.

Referring to FIGS. 2 and 5, for a vertical flush wall, preferably elongated holes 29 and forward cylindrical holes 25 are employed for pinning. Upper sections 33*a* of pins 33 locate in elongated holes 29. The legs 33*b* extend into forward cylindrical holes 25. Preferably two pins 33 are employed for each block 11 in the upper tier. As in the offset wall, the vertical flush wall can be built curved, either convex or concave. Although not shown, additional pins 33 will extend downward from the lower tier of blocks 11 into a next lower tier in the same manner. Similarly, additional pins 33 will extend upward from the upper tier of blocks 11 into a next upper tier.

Referring to FIG. 3 again, block 11 also has two score lines on its bottom 17 which extend from rear wall 19 to front face 13. Score line 39 is parallel to one side 24, while score line 37 is parallel to the other side wall 24. Delivering a blow with a chisel to these score lines 37, 39 will shorten the width of the block. When forming curved walls, the side walls 24 of upper and lower tiers of blocks may begin to intersect each other. If so, one or more of the shorter width blocks 11 will be inserted into a tier for repositioning. This enables the blocks 11 to be properly positioned so that their sidewalls 24 do not intersect with adjacent upper and lower tiers as a wall is being built.

The invention has significant advantages. The lugs on the blocks facilitate stacking them on another, holding them in place without the need for pins in short walls. Removing one of the lugs allows the blocks to be stacked in a flush mode. The enlarged heads on the pins and the row of elongated holes allows pins to be readily employed for higher walls.

In addition, for fairly high retaining walls, it will be desirable to anchor the tiers into the earth. A mesh screen (not shown) is employed. A forward portion of the mesh screen locates between upper and lower tiers and is pierced by pins 33. The rearward portion extends into earth for anchoring.

While the invention has been shown in only one of its forms, it should be apparent to those skilled in the art that it is not so limited but is susceptible to various changes without departing from the scope of the invention.

What is claimed is:

1. A plurality of building blocks for a wall, each of the blocks comprising:

a top, bottom, two sides facing in opposite directions, a forward end and a rearward end;

the bottom having a length greater than the top, defining an extension portion which extends rearward;

at least one rearward lug protruding from the extension portion of the bottom;

at least one forward lug protruding from the bottom adjacent to and forward of the rearward lug; wherein an upper row of the blocks is stackable on a lower row of the blocks in an offset mode with the forward ends of the blocks of the upper row recessed from the forward ends of the blocks of the lower row and the forward lugs of the blocks of the upper row engaging the rearward ends of the blocks of the lower row; and the forward lugs are removable so as to allow the upper row of the blocks to be stackable on the lower row of the blocks in a flush mode with the forward ends of the blocks of the upper and lower rows being substantially flush with each other, and with the rearward lugs of the of the blocks of the upper row capable of engaging the rearward ends of the blocks of the lower row.

2. The blocks according to claim 1, wherein each of the blocks further comprises:

a plurality of holes in the top and bottom of the block; and pin means for insertion in mating ones of the holes of the blocks of the upper and lower rows to interlock them together both in the offset mode and the flush mode.

3. The blocks according to claim 2 wherein all of the holes extend completely through each of the blocks from the bottom to the top.

4. The blocks according to claim 1, wherein each of the blocks further comprises:

a forward array of holes extending through the block from the top to the bottom, spaced from one of the sides to the other of the sides;

a rearward array of holes extending through the block from the top to the bottom, spaced generally parallel to the forward array; and a plurality of pins for interlocking the blocks of the upper and lower rows with each other, the pins extendable between the forward arrays of the blocks of the upper and lower rows while in the flush mode and extendable between the forward array of the blocks of the upper row and the rearward array of the blocks of the lower row while in the offset mode.

5. The blocks according to claim 1, wherein each of the blocks further comprises:

a forward array of holes extending through the block from the top to the bottom, spaced from one of the sides to the other of the side, at least some of the forward array of holes being elongated to have greater widths than lengths;

a rearward array of holes extending through the block from the top to the bottom, spaced generally parallel to the forward array, the rearward row of holes being cylindrical; and a plurality of pins for interlocking the blocks of the upper row with the lower row, the pins extendable between the forward arrays of the upper and lower rows of the blocks while in the flush mode and extendable between the forward array of the blocks of the upper row and the rearward array of the blocks of the lower row while in the offset mode.

6. The blocks according to claim 5, wherein the pins have enlarged heads which are larger than the rearward array of holes but able to locate within the forward array of holes.

7. The blocks according to claim 1, wherein the rearward end of each of the blocks has an inclined portion relative to the top and the bottom.

8. A method of building a wall with blocks in an offset mode, each of the blocks having a top, a bottom, two sides facing in opposite directions, a forward end and a rearward end, comprising:

providing the bottom of each of the blocks with a length greater than the top, resulting in an extension portion which extends rearward, at least one rearward lug protruding from the extension portion of the bottom, and at least one forward lug protruding from the bottom adjacent to and forward of the rearward lug;

stacking an upper row of the blocks on a lower row of the blocks with the forward ends of the blocks of the upper row recessed from forward ends of the blocks of the lower row and the forward lugs of the blocks of the upper row engaging the rearward ends of the blocks of the lower row.

9. A method of building a wall with blocks in a flush mode, each of the blocks having a top, a bottom, two sides facing in opposite directions, a forward end and a rearward end, comprising:

providing the bottom of each of the blocks with a length greater than the top, resulting in an extension portion which extends rearward, at least one rearward lug protruding from the extension portion of the bottom, and at least one forward lug protruding from the bottom adjacent to and forward of the rearward lug;

removing the forward lugs of the blocks of the upper row and stacking the blocks of an upper row on a lower row with the forward ends of the blocks of the rows being substantially flush with each other and with the rearward lugs of the blocks of the upper row engaging the rearward ends of the blocks of the lower row.

* * * * *